US005565842A

United States Patent [19]

Tamori

[11] Patent Number: 5,565,842

[45] Date of Patent: Oct. 15, 1996

[54] ALARM INFORMATION TRANSFER SYSTEM FOR USE IN A DIGITAL TRANSMISSION DEVICE

[75] Inventor: Mikico Tamori, Kawasaki, Japan

[73] Assignee: Fujitsu Limited, Japan

[21] Appl. No.: 327,183

[22] Filed: Oct. 21, 1994

[30] Foreign Application Priority Data

Mar. 18, 1994 [JP] Japan ..... 6-074122

[51] Int. Cl.[6] ..... G08B 29/00

[52] U.S. Cl. ..... 340/506; 340/505; 340/517; 340/518; 340/825.14

[58] Field of Search ..... 340/506, 505, 340/517, 518, 825.06–825.14

[56] References Cited

U.S. PATENT DOCUMENTS 4,672,374 6/1987 Desjardins ..... 340/825.07

4,673,920 6/1987 Ferguson ..... 340/505

4,994,788 2/1991 Philippe et al. ..... 340/505

*Primary Examiner*—Donnie L. Crosland

*Attorney, Agent, or Firm*—Greer, Burns & Crain, Ltd.

[57] ABSTRACT

An alarm information transfer system used in a digital transmission device can overcome a problem that all communications are stopped when a clock signal, which is sent from a master unit to slave units, is disconnected. In this system, the master unit sends ID numbers sequentially for specifying slave units, and alarm information is sent to the master unit from a slave unit specified by an ID number. The other slave units which are not specified by the ID numbers sent from the master unit store the alarm information sent from the specified slave unit, and one of the slave units detecting the disconnection of the clock signal from the master unit becomes a master unit to continue communication.

8 Claims, 9 Drawing Sheets

ALARM INFORMATION TRANSFER SYSTEM FOR USE IN A DIGITAL TRANSMISSION DEVICE

BACKGROUND OF THE INVENTION

1. Field of the Invention

The present invention relates to an alarm information transfer system in a digital transmission device.

2. Description of the Related Art

In recent years, there are various kinds of alarm information for notifying fault found in devices, circuits and the like, due to improvement of functions of the devices, the circuits composing the devices, and the like.

Therefore, it is not sufficient to use a system in which only some of the units collect alarm information from other units. From the view point of reliability, it is desirable to use a system in which alarm information can be shared among each of the units.

FIG. 6 shows one example of the conventional alarm information transfer system to cover the above described demands.

In FIG. 6, reference numerals 1, 2 . . . n mean the plurality of alarm information transfer circuits, all of which are provided in one device. Each of the alarm information transfer circuits has the same structure.

One of the alarm information transfer circuits is used as a master unit 1, and others are used as slave units 2 to n. Hereinafter, alarm information transfer units are referred to as units.

A master unit 1 supplies a clock CLK and a flame pulse FP. All slave units 2 to n receive alarm information collected from a corresponding alarm information source 40 and store it in the data memory 10. The alarm information source 40 of CPU generates alarm information, referred to as alarm information.

The slave units 2 to n convert several kinds of alarm information stored in the data memory 10 to serial data in a predetermined time, according to unit numbers set by an ID setting circuit 50 in advance, and transfer the data to the master unit 1.

The serial data is multiplexed in a time-sharing manner, so that alarm information from each of the slave units 2 to n is collected in the master unit 1. The collected data is stored in the data memory 10 of the master unit 1, and referenced successively under the control of CPU 40 of the master unit 1.

In the conventional system, the master unit 1 and other slave units 2 to n are defined individually, to transfer the alarm information data from the slave units 2 to n to the master unit 1, unilaterally.

Thus, the alarm information from other units can not be referred on from the CPU 40, to the other slave units 2 to n. Accordingly, a problem is that the overall system can not deal with a fault indicated by the alarm rapidly.

Further, only the master unit 1 has the supply source of clock CLK and flame pulse FP in the conventional system, so that the clock CLK and flame pulse FP can not be supplied from other slave units, when the clock CLK or the flame pulse FP supplied from the master unit 1 are disconnected. Therefore, another problem is that all communications are stopped when the clock CLK or the frame pulse FP supplied from the master unit 1 is disconnected.

SUMMARY OF THE INVENTION

It is therefore an object of the present invention to provide an alarm information transfer system to overcome the shortcomings of the conventional system.

It is another object of the present invention to provide an alarm information transfer system in which all of the plurality of units have common structure.

It is a further object of the present invention to provide an alarm information transfer system for transferring alarm information by using one unit of the plural units as a master unit and other units as slave units, and synchronizing with a clock from the master unit, wherein the communication can be continued by turning one of the slave units to a master unit, when the clock from the initial master unit is disconnected.

An alarm information transfer system for use in a digital transmission device includes a plurality of alarm information transfer circuits, one of which is used as a master unit and the other alarm information transfer circuits of which are used as a plural of slave units. The master unit sends ID numbers for specifying a slave unit to send alarm information, subsequently, the slave unit specified according to the ID numbers, sending back alarm information to the master unit and other slave units, the other slave units which are not specified by the master unit or according to the ID numbers storing the sent alarm information. The slave unit, which receives a clock pulse from the master unit, is specified according to the ID number to send out the alarm information by synchronizing the clock signal. Further, any of the slave units which detects a disconnection of the clock signal becomes a master unit, and sends the series ID numbers to the other slave units.

Further, other objects of the present invention will become clear by the description for explaining embodiments according to the attached drawings and claims.

DETAILED DESCRIPTION OF THE PREFERRED EMBODIMENTS

Figure 1A:
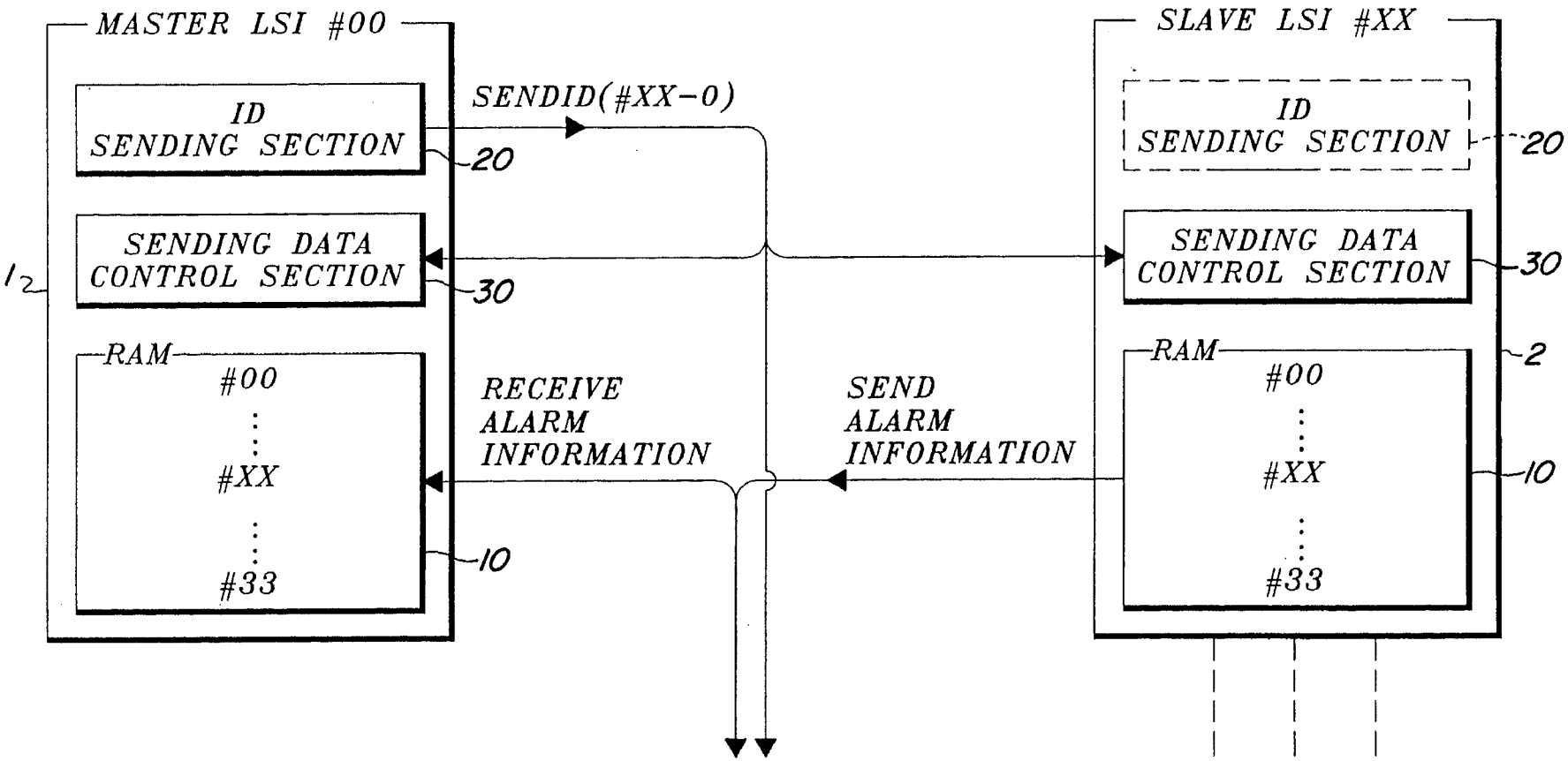
FIGS. 1A and 1B show a diagram for explaining a concept of an alarm information transfer system according to the present invention.
Figure 1B:
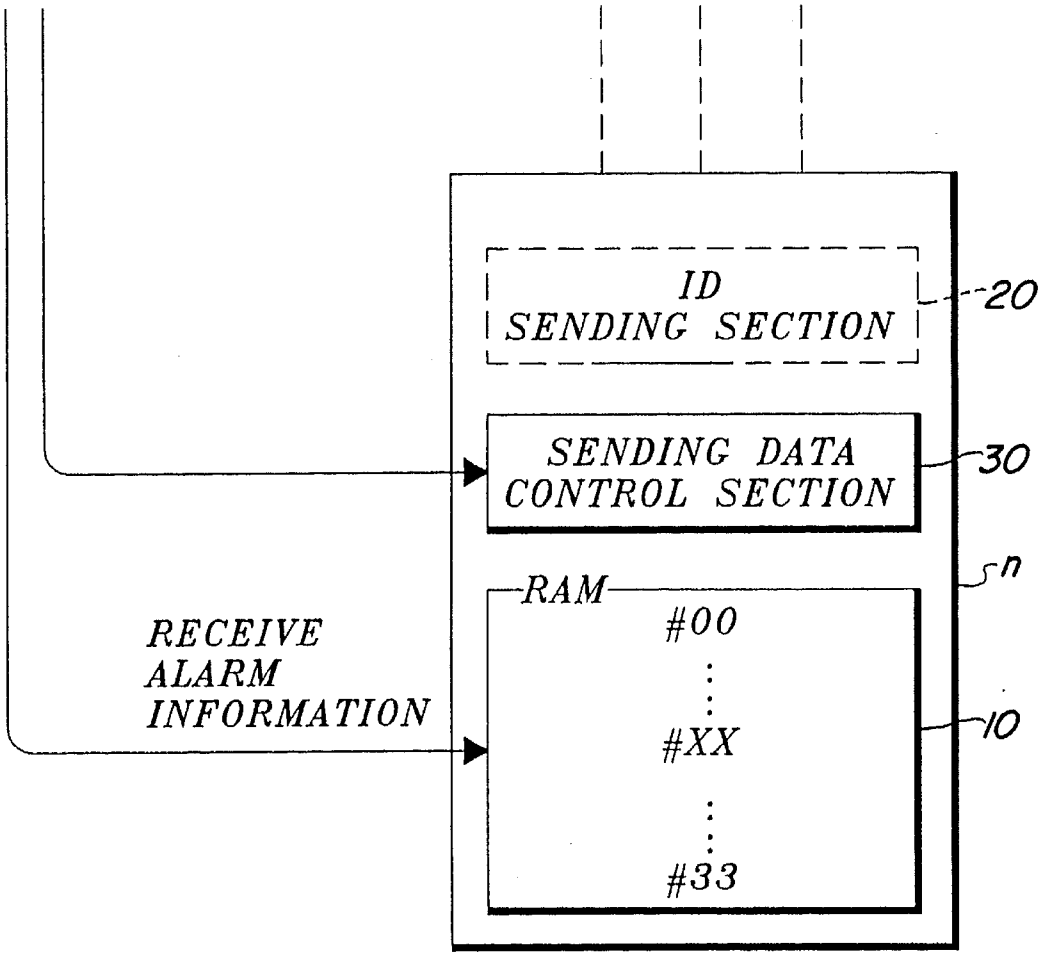
Figure 1:
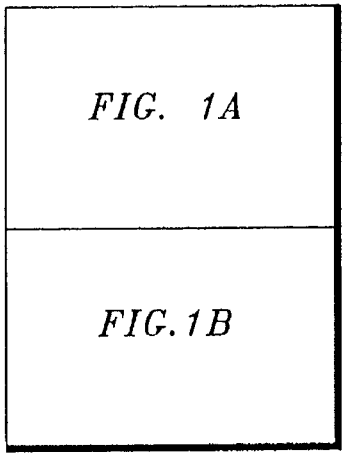
FIG. 1 is an arrangement of views for FIGS. 1A and 1B.

FIGS. 1A and 1B show a diagram for explaining a concept of an alarm information transfer system according to the present invention. Throughout the following descriptions, the same reference numerals are used to denote and identify corresponding or identical components.

As explained above according to the conventional system, a unit 1 which is one of the plural alarm information transfer circuits is used as a master unit, and units 2 to n which correspond to other alarm information transfer circuits used as slave units in the initial status.

The master unit 1 and the slave units 2 to n are devices having the same structure, which are constituted of LSIs. Each of the units comprises a RAM 10, an ID sending section 20, and a sending data control section 30.

The ID sending section 20 of the master unit 1 sends an ID number (No.) to each of the slave units 2 to n in common. The ID number (No.) sent from the master unit 1 is compared with each ID number (No.) which is predetermined in each of the sending data control sections 30 of all slave units 2 to n which respectively are connected to the transfer lines.

The RAM 10 which is built in each unit stores alarm information on the position corresponding to the address which is obtained by converting the ID number.

The slave unit having the ID number corresponding to that sent from the master unit 1 is placed in a mode for sending back alarm information. Then, the slave unit sends back to the master unit 1 the alarm information stored in the address position of the built-in RAM 10, corresponding to its own ID number.

On the other hand, the slave unit having an ID number which does not corresponds to that sent from the master unit 1 is placed in a mode for receiving the alarm information from other slave units. Then, the unit receives and memorizes the alarm information received from other slave units in the address position of RAM 10 corresponding to the ID number which is recieved.

Further, FIGS. 1A and 1B show an example of an alarm information transfer system in which there are address positions corresponding to the ID numbers of 00 to 33 in each RAM 10.

In this way, transfer communication of the alarm information is performed by sending the set ID number from the master unit 1, at time intervals, and repeating the above-described sequence.

Figures 2, 2A:
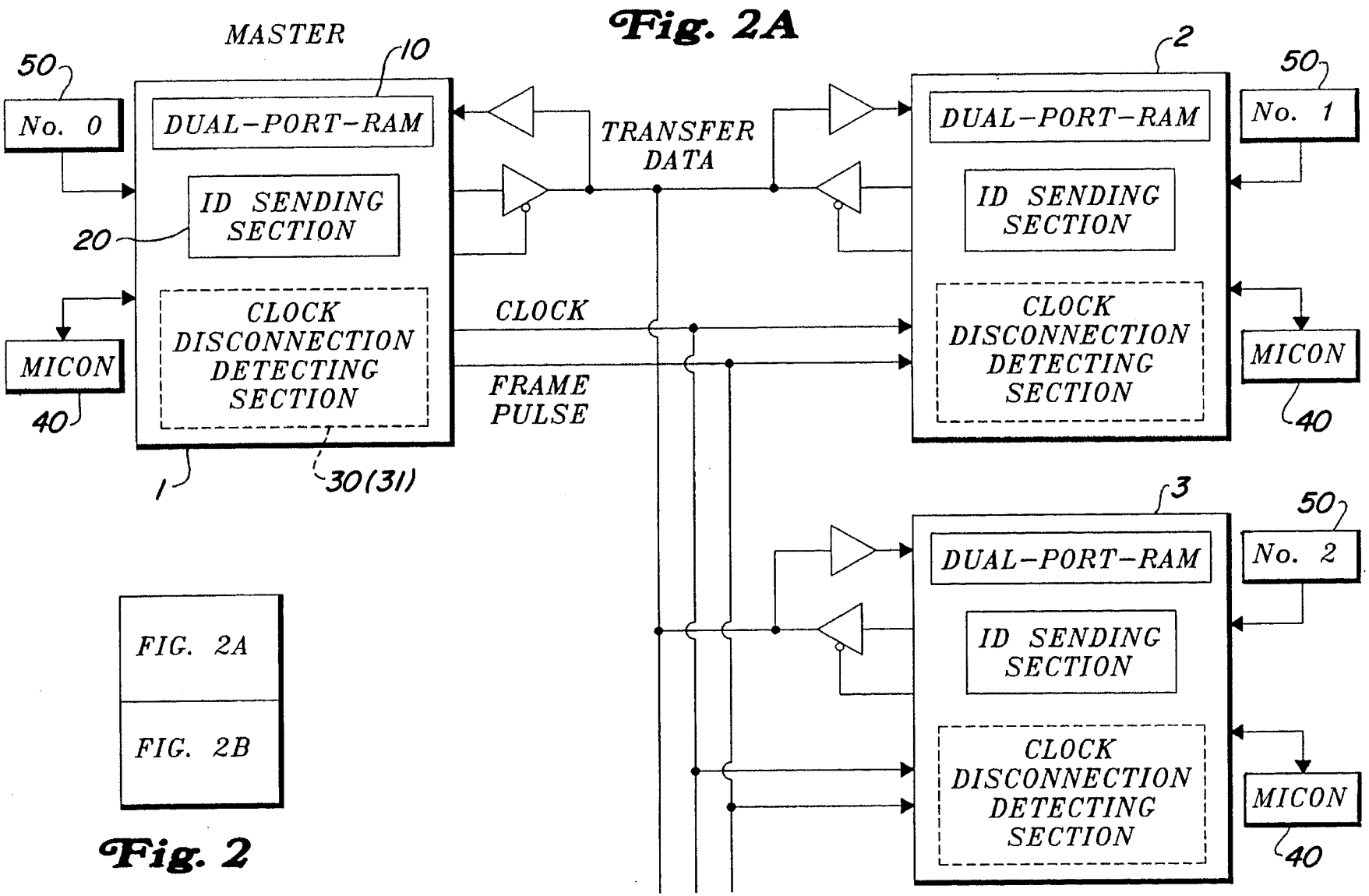
FIG. 2 is an arrangement of views for FIGS. 2A and 2B.
FIGS. 2A and 2B show a block diagram of an embodiment at the normal status, according to the present invention.
Figure 2B:
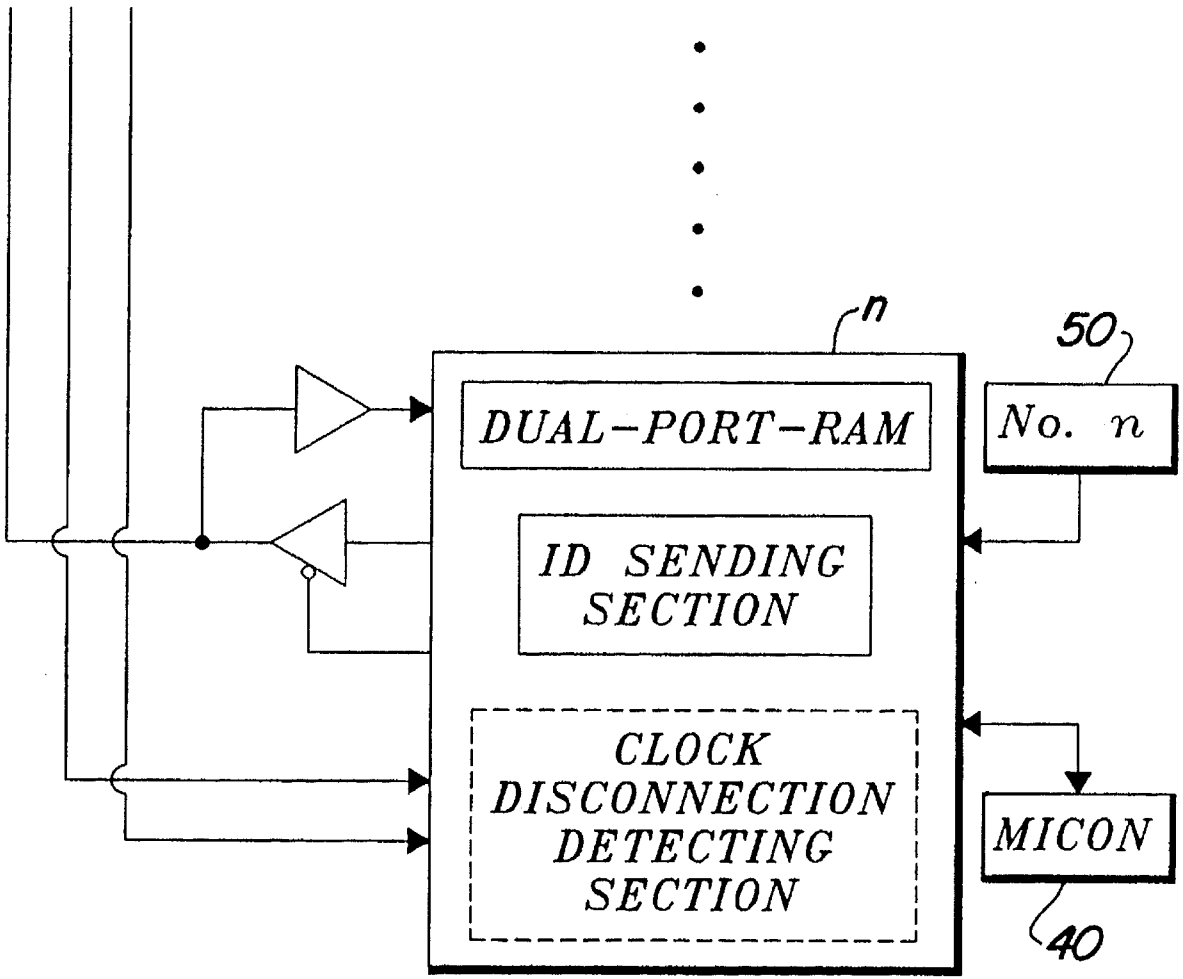

FIGS. 2A and 2B are diagrams illustrating one embodiment of the present invention during normal operation. As described above, the diagram shows the status where the unit 1 is a master unit. The ID number for each unit is set in each ID setting circuit 50. The ID numbers for all units including the master unit are set as numbered in order, unlike the case of the conventional system.

And the ID number 0 is set to the unit 1 as the master unit in the initial status.

Further, in comparison with the embodiment shown in FIGS. 1A and 1B, the RAM 10 which is used as a data memory commonly provided on each unit is a dual port RAM. In addition, a clock disconnection detecting section is included as a part of the sending data controlling section 30.

The dual port RAM 10 is used for storing the transferred data and the data to be transferred. The RAM 10 has a capacity of 256 bits in this embodiment.

The ID sending section 20 send out the ID number in only the master unit, and has a circuit for generating and outputting the ID numbers of slave units, which instruct the slave units to send back the alarm information as explained above according to FIGS. 1A and 1B.

Considering the entire system, the ID number 0 and the ID numbers 1 to n are respectively defined and set on the unit 1 used as the master unit and the units 2 to n as the slave units, in the initial status.

The above-described clock disconnection detecting section 31 detects the disconnection of the clock CLK and the frame pulse FP, which are supplied from the master unit 1 when the unit is a slave unit. The time period for monitoring the clock for detecting the disconnection is protracted 10 by 10 periods, subsequently, in accordance with the series ID number of the unit. For example, the time is 10 periods for the unit having the ID number 0, 20 periods for the unit having the ID number 1, and 30 periods for the unit having the ID number 2. The reason becomes apparent on the later explanation.

Further, a CPU 40 for referring the content of the dual port RAM 10 includes of a micro computer, as one example.

The case where the unit 2 is specified as a slave unit, which should receive the data of alarm information from the unit 1, which is a master unit, will now be considered. The ID number 1 is generated in the ID sending section 20 of the unit 1, and is sent to the unit 2. In correspondence with that, the ID number 1 sent from the master unit is compared with its own ID number and the correspondence is detected, in the unit 2, which is a slave unit, and set in the ID number 1.

Then, the alarm information stored on the address position corresponding to the ID number 1 of the dual port RAM 10 is read out and sent out in a serial data format.

On the other hand, the master unit 1 and other slave units, which do not recognize the appropriate ID number 1 as their own ID numbers, that is, the units 3 to n, store the alarm information sent from the slave unit 2 on the address position corresponding to the ID number 1 of the dual port RAM 10.

Then, the ID number 2 is sent out from the unit 1, in the same way, and so the slave unit 3 set in the ID number 2 reads the alarm information from the RAM 10 and sends it out in the serial data format.

The alarm information is also written and stored on the address position corresponding to the ID number 2 of the RAM 10 in the master unit 1 and other slave units 2 and 4 to n.

Figures 3, 3A:
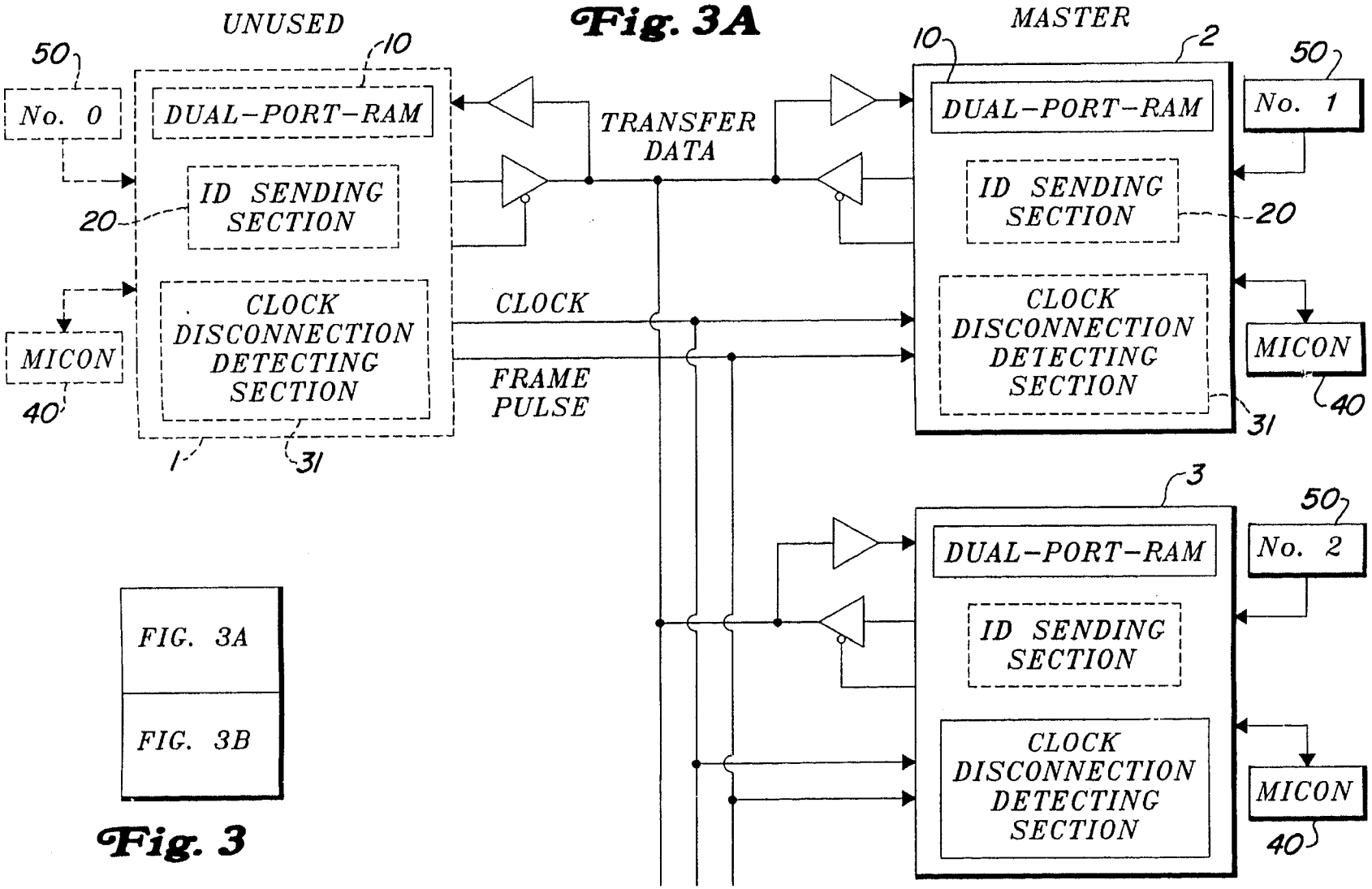
FIG. 3 is an arrangement of views for FIGS. 3A and 3B.
FIGS. 3A and 3B show a block diagram of an embodiment at the time of clock disconnection, according to the present invention.
Figure 3B:
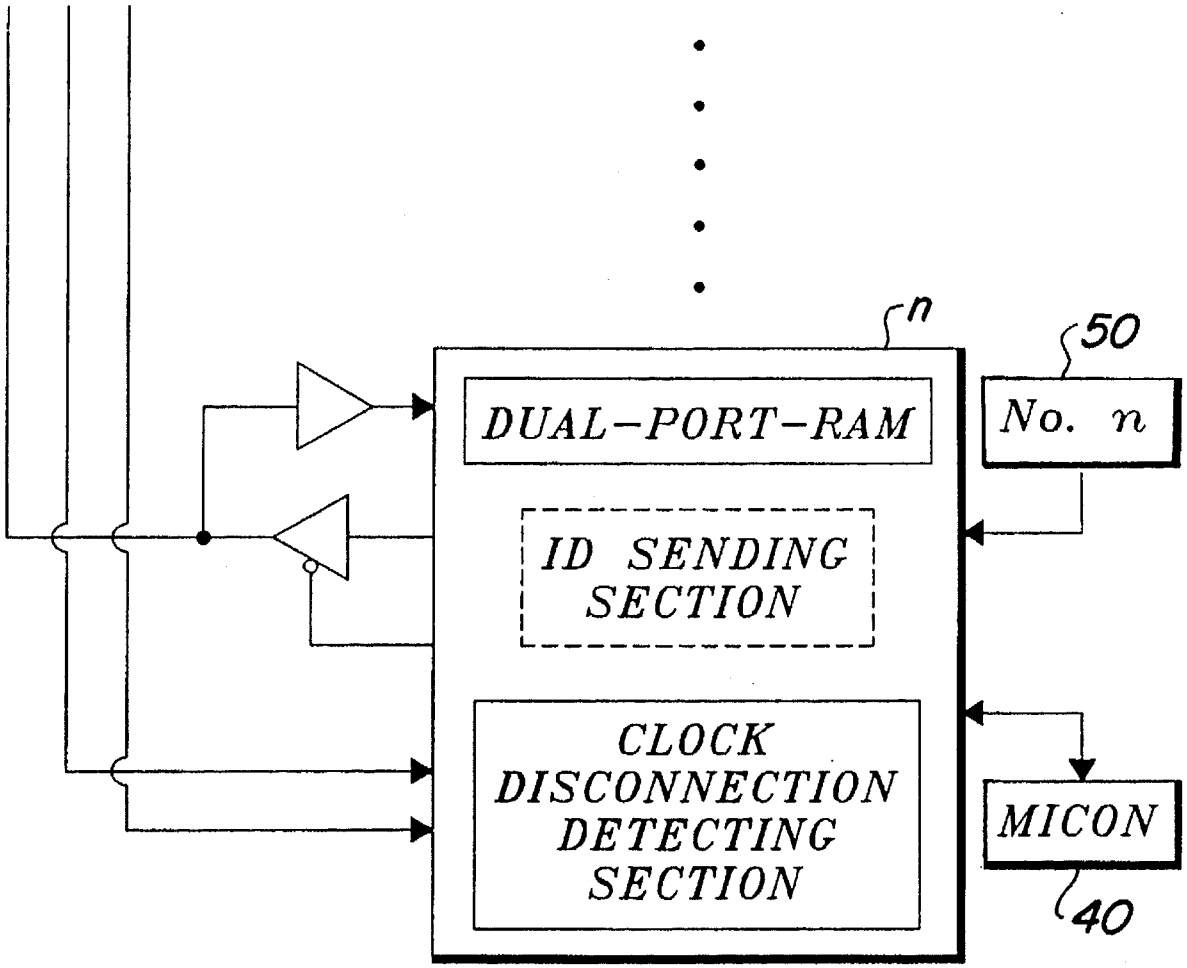

On the other hand, the operation as shown in FIGS. 3A and 3B is performed, if the clock signal CLK supplied from the unit 1 is disconnected, when the unit 1 to which the ID number 0 is set is a master unit.

More particularly, the clock CLK supplied from the unit 1 is disconnected, so that the units 2 to n can not detect the ID number. As the result, it becomes impossible to transfer the alarm information to the unit 1. This is because that the data stored in each unit is received and sent by synchronizing with the clock CLK from the master unit.

Accordingly, the disconnection of the clock CLK is detected at first in the clock disconnection detecting section 31 of the unit 2, which is a slave unit having the shortest clock monitoring period time, selected from the units which are operated under normal circumstances, when the clock CLK is disconnected.

The disconnection of the clock CLK is detected in the clock disconnection detecting section 31 of the unit 2, and then, the clock CLK and the frame pulse FP are sent from the sending data control section 30 including the appropriate clock disconnection detecting section 31 of the unit 2. Therefore, the unit 2 then becomes used as a master unit and the unit 1 becomes an unused unit.

When the unit 2 becomes the master unit, the unit 2 sends numbers corresponding to units specified by the unit 2, subsequently, the same as the case where the unit 1 is used as the master unit, as described in FIGS. 2A and 2B.

Moreover, the slave unit specified according to the appropriate ID number reads the alarm information stored in the RAM 10 and sends it to other units. Further, a new master unit 2 and other slave units receive the alarm information from the appropriate specified slave unit and store it onto the address position corresponding to the ID number of the RAM 10.

Figure 4:
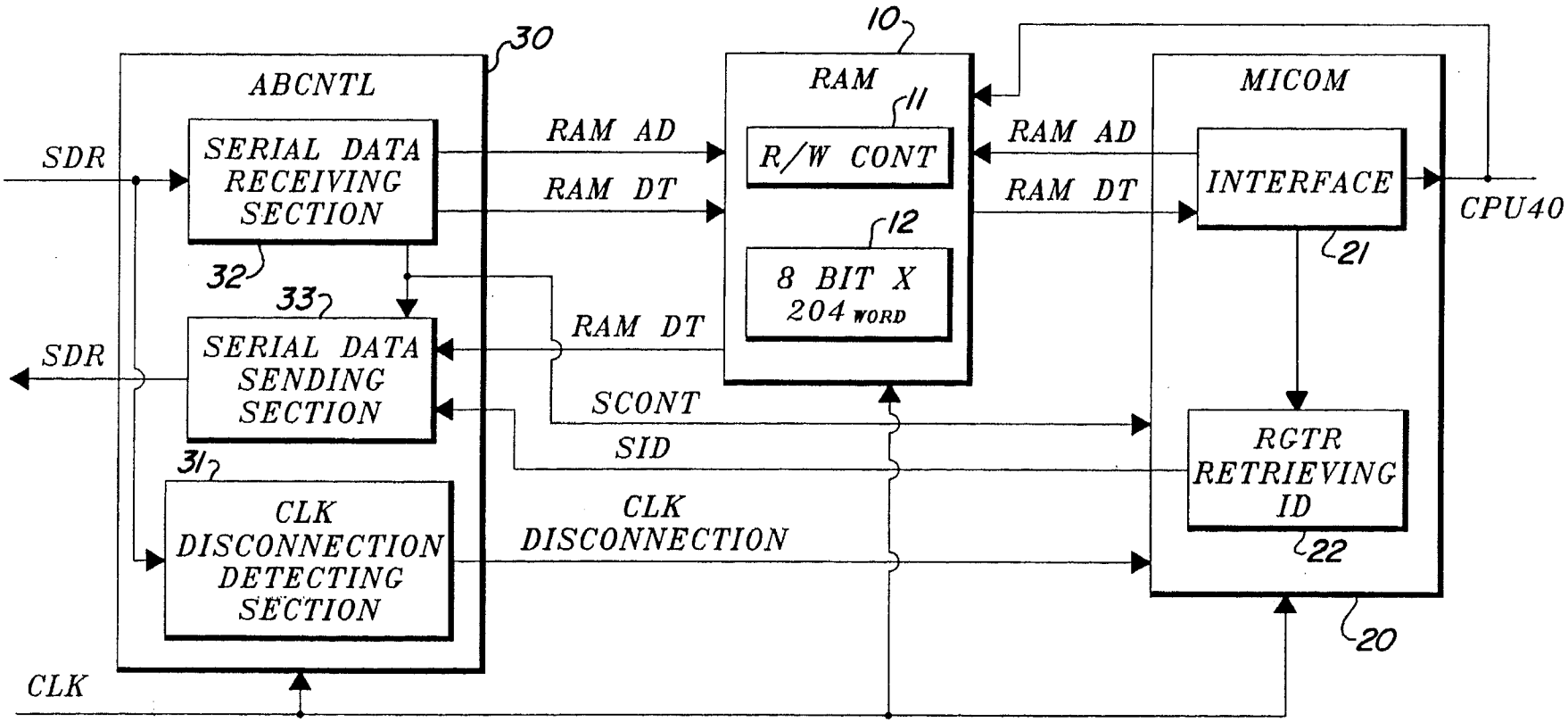
FIG. 4 is a diagram showing an example of the structure of an alarm information transfer unit.
Figure 5:
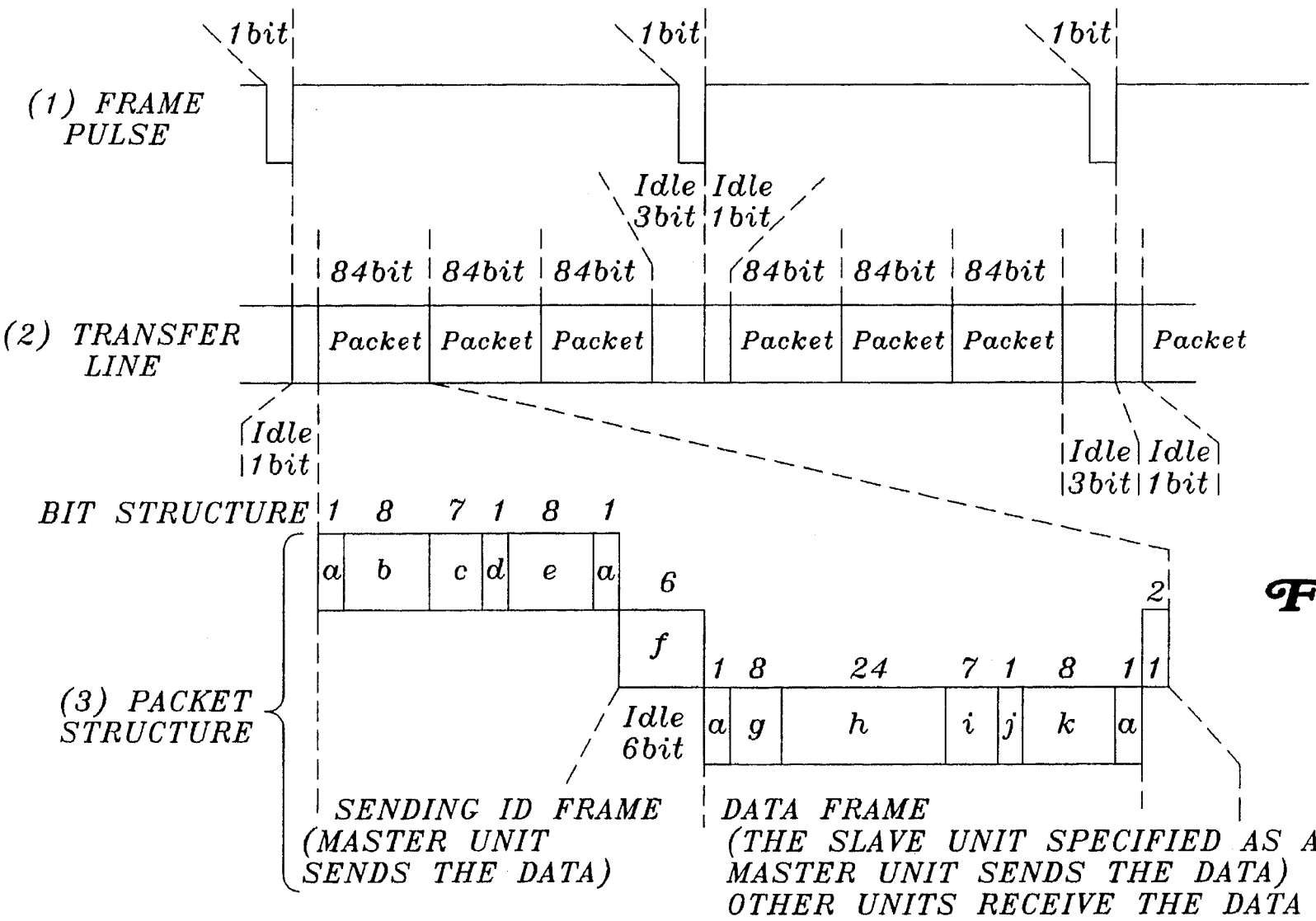
FIG. 5 is a diagram explaining a format for a transfer signal.
Figure 6:
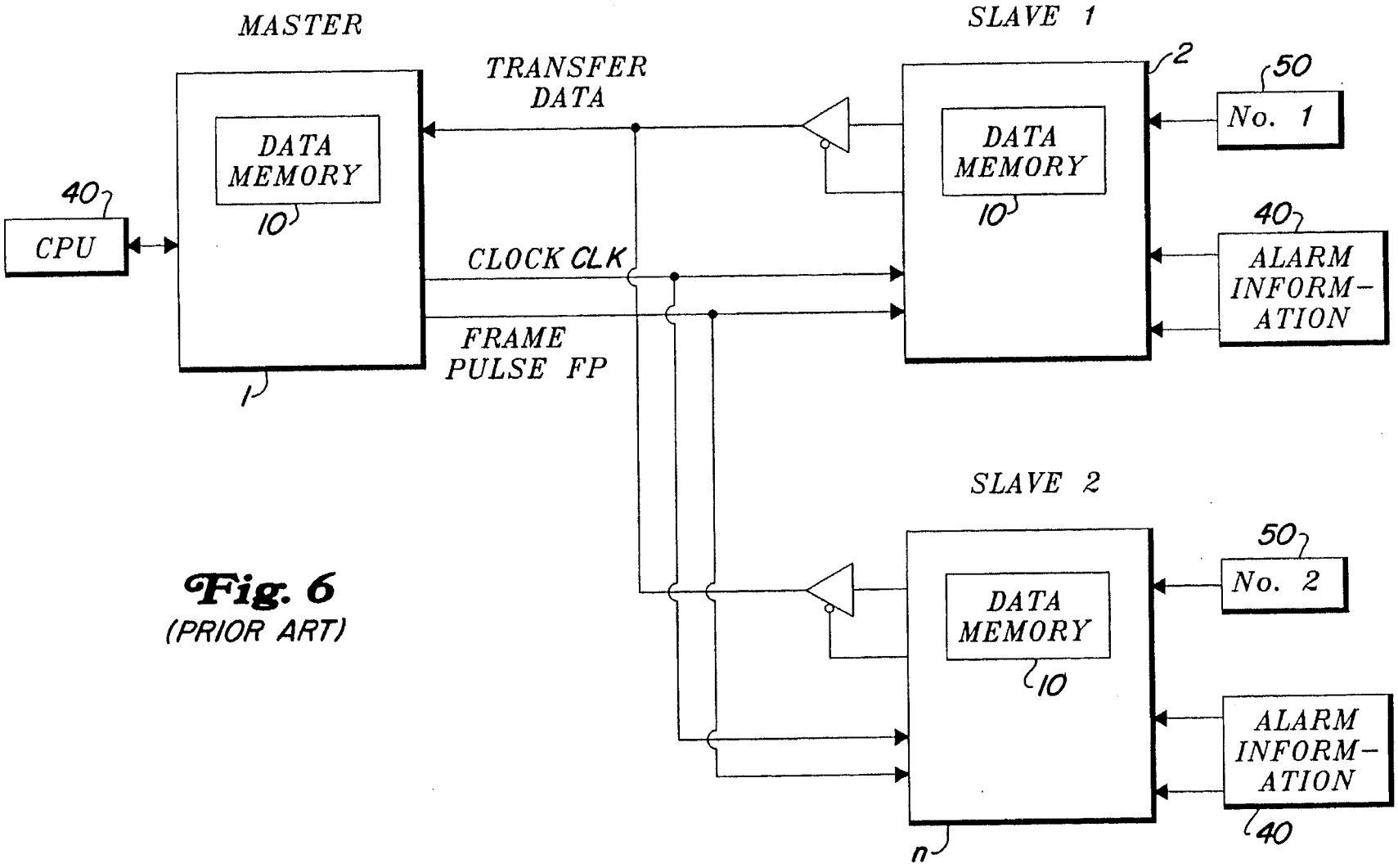
Fig. 6 (PRIOR ART)
FIG. 6 is a block diagram for explaining the conventional alarm information transfer system.

FIG. 4 is a block diagram showing a more detailed structure of each unit in the above-described embodiment. FIG. 5 illustrates one embodiment of a transfer signal format for sending the ID number and the data which is an alarm information.

In FIG. 5, (1) of FIG. 5 shows a frame pulse FP sent out from the master unit to specify the frame timing. As shown in (2) of FIG. 5, one frame is composed of 256 bits. One frame has one idle bit at the head of the frame, three idle bits at the back of the frame, and three packets, each of which is composed of 84 bits, provided between the head idle bit and the back idle bits.

Further, as shown in (3) of FIG. 5, one packet is composed of the frame of the ID number sent from the master unit and the data frame for the alarm information sent from the slave unit which is specified from the master unit.

In FIG. 4, a sending data control section 30 comprises a clock disconnection detecting section 31, a serial data receiving section 32 and a serial data sending section 33.

The serial data receiving section 32 receives the ID number on the ID frame sent with the transfer format as described above according to FIG. 5, and the alarm information on the data frame with the serial data format.

The serial data receiving section 32 has the functions converts the ID number on the received ID frame to the address of the RAM 10 and compares the ID number on the received ID frame with its own ID number set and stored in advance.

The serial data sending section 33 inserts the data read from the RAM 10 to the data frame with the serial data format, according to the format shown in FIG. 5, and sends the data.

The section 33 inserts the ID number from the ID sending section 20 in the ID frame shown in FIG. 5, and sends the data, similarly.

The clock disconnection detecting section 31, which includes a communication control counter, detects the frame pulse FP and the clock signal CLK sent from the master unit to give bit timing of the serial data of the alarm information.

Similarly, the section 31 determines that the clock is disconnected and notifies the ID sending section 20, that the clock is disconnected when the frame pulse FP and the clock CLK are not detected within the predetermined period.

Further, the period for detecting the clock CLK is allocated and set so as to have successively longer periods according to the ID number of each respective unit.

The RAM 10, which is a dual port RAM, includes a reading/writing controller 11 and a storage area 12, that is, a storage area for storing 8 bit×204 words in this embodiment, as a general structure.

The RAM 10 is a dual port RAM, so that it is possible to read/write from/to both the sending data controlling section 30 and the ID sending section 20.

That is, the received serial data ID number from the serial data receiving section 32 is converted to the address of the RAM 10, and the alarm information data is stored in the address position of the RAM 10.

On the other hand, the alarm information data from the CPU 40 is written or read in the appropriate address position based on the RAM address from the ID sending section 20, and sent out to the CPU 40 for reference.

Further, the alarm information data stored in the appropriate address position is read out based on the RAM address from the ID sending section 20, and sent via the serial data sending section 33.

The ID sending section 20 includes a micro computer and has an interface section 21 and a register 22, as functional components. The interface section 21 interfaces between the CPU 40 and the RAM 10, as described above, and controls writing and reading of the alarm information to and from the RAM 10.

The register 22, in which the ID number for each unit is stored, has functions for retrieving and reading the serial ID number, and sending it to the serial data sending section 33, when the unit becomes a master unit.

In the above-described structure of alarm information transfer units, each of operations in the case where the unit is a master unit, the case where the unit is a slave unit which was specified according to the ID number from the master unit, and the case where the unit is one slave unit other than the slave unit specified according to the ID number from the master unit will be described as follows.

When the unit is a master unit, the register 22 of the ID sending section 20 retrieves the ID number of each unit, and sends them out to all the slave units via the serial data sending section 33.

Then, the ID number of the appropriate unit and the alarm information are sent from the slave unit corresponding to the sent ID number, in accordance with the format shown in FIG. 5. The ID number and the alarm information are detected in the serial data receiving section 32. When detecting, the received ID number is converted to the address signal (RAM AD) of the corresponding RAM 10.

Accordingly, the alarm information (RAM DT) is written on the address position of RAM 10 corresponding to the converted address signal (RAM AD).

In the case where the unit is a slave unit specified according to the ID number from the master unit, the received ID number is compared with its own stored ID number to detect the correspondence, in the serial data receiving section 32. If there is correspondence, the unit goes into mode for sending the alarm information.

The detection of correspondence of the ID number is sent from the serial data receiving section 32 to the ID sending section 20. The ID sending section 20 receiving the notification of correspondence sends the RAM address (RAM AD) corresponding to its own ID number to the RAM 10 to read its own alarm information to be sent, in the interface section 21.

Accordingly, the RAM 10 sends the alarm information stored in the RAM address (RAM AD) corresponding to its own ID number, with the control of the reading/writing controller 11, and sends it to the serial data sending section 33.

The alarm information stored in the RAM address (RAM AD) corresponding to its own ID number is the alarm information sent from the CPU 40 and is stored in advance.

Further, in the case where the unit is the slave unit other than the slave unit specified according to the ID number from the master unit, correspondence is not detected when the received ID number is compared with its own stored ID number.

In this case, the alarm information is received the same as in the master unit, and stored in the address position of the RAM 10 corresponding to the received ID number.

The operations of each unit in the normal status are described above. The case where the clock CLK from the master unit can not be sent for its fault will be explained as follows.

The period for detecting clock signals is set in advance to successively longer time periods according to the ID number of each unit.

Accordingly, the disconnection of the clock CLK is detected in the slave unit having the shortest clock detecting period among the slave units which operates normally.

Then, the slave unit which detects the disconnection of the appropriate clock CLK sends the disconnection of the clock CLK to the ID sending section 20. The ID sending section 20 controls to switch from the slave unit to the master unit, when the ID sending section 20 receives the disconnection. That is, the section starts sending by retrieving the series ID number in the register 22 which is located below the interface section 21.

And the unit which has been the master unit till then becomes the unused unit. The operation after this operation performs as same as that in the normal status.

As described above, according to the embodiments, the alarm information transfer system according to the present invention makes it possible to switch from the slave unit to the master unit when the clock is disconnected.

Accordingly, the problem that all communication is stopped upon disconnection of the clock will be overcome according to the present invention, so that the alarm information can be stored in all the units, effectively. Therefore, it becomes possible to deal with the alarm, rapidly, and it further becomes possible to improve reliability of the system.

The devices in each unit may be duplicated to improve the reliability, in the above present embodiments. Even if modifications should be made in the devices of each units, it should be of course understood that those which are the same as the technical concept of the invention are within the protective scope of this invention.

What is claimed is:

1. An alarm information transfer system for use in a digital transmission device comprising:

a plurality of alarm information transfer circuits;

one of which is used as a master unit, and the other alarm information transfer circuits being used as slave units, the master unit sending ID numbers for specifying a slave unit to send alarm information, the slave units specified according to the ID numbers sending back alarm information to the master unit and other slave units, whereby the other slave units which are not specified by the master unit ID numbers store received alarm information, wherein, the specified slave unit, which receives a clock signal from the master unit and is specified according to the ID number, sends out the alarm information by synchronizing with the clock signal, and further, any of the slave units which detects a disconnection of the clock signal becomes a master unit, and sends the series of ID numbers to the other slave units.

2. The alarm information transfer system according to claim 1, wherein the plurality of alarm information transfer circuits are provided in one digital transmission device.

3. The alarm information transfer system according to claim 1, wherein each unit comprises:

a memory for storing the alarm information;

an ID sending section for retrieving and outputting the ID numbers to be sent; and a sending data control section having a clock disconnection detecting section for detecting the disconnection of the clock signal and wherein the master unit retrieves and sends out the ID numbers sequentially from the ID sending section, receives alarm information which is transferred from the slave units corresponding to the ID numbers, and stores the alarm information at an address position corresponding to each of the ID numbers, in the memory.

4. An alarm information transfer system according to claim 1, wherein each unit comprises:

a memory for storing the alarm information; and a sending data control section having a clock disconnection detecting section for detecting the disconnection of the clock signal and wherein the slave unit becomes a new master unit when the disconnection of the clock signal is detected in the clock disconnection detecting section to retrieve and send out the ID numbers sequentially from the ID sending section.

5. An alarm information transfer system according to claim 1, wherein each unit comprises:

a memory composed of a dual port RAM for storing the alarm information;

an ID sending section for retrieving and outputting the ID number to be sent; and a sending data control section including, a clock disconnection detecting section for detecting the disconnection of the clock signal and notifying the disconnection of the clock signal to the ID sending section, a serial data receiving section for receiving the ID number and the alarm information sent in a serial data form, converting the received ID number to the corresponding address of the memory, and detecting that the received ID number corresponds to an ID number assigned in advance, and a serial data sending section for sending out the unit's own ID number and the alarm information with the serial form.

6. An alarm information transfer system according to claim 5, wherein there is further provided a CPU and alarm information sent from the CPU in advance as alarm information to be sent from the unit, the alarm information being stored in the address position corresponding to the unit's own ID number of the RAM.

7. The alarm information transfer system according to claim 1, wherein the plurality of the slave units are assigned subsequently longer periods for response to a disconnection detection, and each of the plurality of the slave units has a memory and stores each of the assigned periods in advance in the memory, so that the disconnection of the clock signal is detected by the slave unit to which the shortest period is assigned.

8. An alarm information transfer system for use in a digital transmission device comprising:

a plurality of alarm information transfer circuits, one of which is used as a master unit, and the others of which are used as slave units, the master unit sending ID numbers, each for specifying one of the slave units to send alarm information, sequentially, and outputting a clock signal, each of the slave units, which are specified by the ID numbers, sending alarm information back to the master unit, synchronized with the clock signal, other slave units, which are not specified by the ID numbers, receiving and storing the alarm information, and one of the slave units which detects a disconnection of the clock signal because the clock signal can not be inputted, becoming a new master unit, and sending the ID numbers to other slave units.

* * * * *

UNITED STATES PATENT AND TRADEMARK OFFICE

CERTIFICATE OF CORRECTION

PATENT NO. : 5,565,842
DATED : October 15, 1996
INVENTOR(S) : Tamori

It is certified that error appears in the above-indentified patent and that said Letters Patent is hereby corrected as shown below:

Column 3, line 26, delete "corresponds" and insert --correspond--.

Column 5, line 31, delete "has the functions".

Column 5, line 40, delete "inserts" and insert --also inserts--.

UNITED STATES PATENT AND TRADEMARK OFFICE

CERTIFICATE OF CORRECTION

PATENT NO. : 5,565,842

DATED : October 15, 1996

INVENTOR(S) : Tamori

It is certified that error appears in the above-indentified patent and that said Letters Patent is hereby corrected as shown below:

Column 5, line 52, delete "periods" and insert -- periods,--.

Column 6, line 43, delete "into" and insert -- into a--.

Signed and Sealed this

Sixteenth Day of September, 1997

*Attest:*

Bruce Lehman

BRUCE LEHMAN

*Attesting Officer*

*Commissioner of Patents and Trademarks*